US005132734A

United States Patent [19]

Momiyama et al.

[11] Patent Number: 5,132,734

[45] Date of Patent: Jul. 21, 1992

[54] DEVELOPING APPARATUS

[75] Inventors: Yoshiharu Momiyama; Shigeki Nakajima; Hiroshi Kikuchi; Yoshitomo Koga; Yukio Ota, all of Tokyo, Japan

[73] Assignee: Oki Electric Industry Co., Ltd., Tokyo, Japan

[21] Appl. No.: 634,348

[22] Filed: Dec. 26, 1990

[30] Foreign Application Priority Data

Dec. 26, 1989 [JP] Japan ..... 1-335069

[51] Int. Cl.[5] ..... G03G 15/09

[52] U.S. Cl. ..... 355/253; 118/658; 355/245; 355/260

[58] Field of Search ..... 355/245, 259, 260, 251, 355/253; 118/653, 656, 658, 657, 661; 222/DIG. 1

[56] References Cited

U.S. PATENT DOCUMENTS

| | | | |
|---|---|---|---|
| 4,836,135 | 6/1989 | Kohyama et al. | 118/653 |
| 4,959,692 | 9/1990 | Hayashi et al. | 355/253 |
| 4,965,639 | 10/1990 | Manno et al. | 355/260 |

FOREIGN PATENT DOCUMENTS

| | | | |
|---|---|---|---|
| 0270104 | 6/1988 | European Pat. Off. . | |
| 2602597 | 2/1988 | France . | |
| 0015269 | 1/1984 | Japan | 355/253 |
| 0047977 | 3/1986 | Japan | 355/251 |
| 0153879 | 7/1987 | Japan | 355/251 |
| 0225274 | 9/1988 | Japan | 355/253 |
| 63-231469 | 9/1988 | Japan . | |

OTHER PUBLICATIONS

Patent Abstracts of Japan, vol. 12, No. 388 (P-771) [3235], 17 Oct. 1988; & JP-A-63 129 366 (Matsushita Electric) Jan. 6, 1988.

*Primary Examiner*—A. T. Grimley
*Assistant Examiner*—Thu Anh Dang
*Attorney, Agent, or Firm*—Wenderoth, Lind & Ponack

[57] ABSTRACT

A developing apparatus includes restriction member disposed midway of a route through which developer is delivered from a hopper to a supply roller. The restriction member restricts the amount of the developer to be supplied to the supply roller. The amount of developer supplied from the supply roller to a developing roller is limited by the provision of the restriction member. The developer on the surface of the developing roller is thinned or doctored by a developing blade and develops an electrostatic latent image on a carrier.

12 Claims, 3 Drawing Sheets

DEVELOPING APPARATUS

BACKGROUND OF THE INVENTION

1. Field of the Invention

The present invention relates to a developing apparatus to be employed in an electronic photograph recorder or an electrostatic duplicator, and the like, particularly to a developing apparatus for supplying a developer from a supply roller to a developing roller, and further delivering the developer to an electrostatic latent image on a carrier, thereby to develop the image.

2. Description of the Prior Art

There are various conventional methods for delivering a toner as a developer to an electrostatic latent image carrier in an electronic photograph recorder and the like, e.g. as disclosed in Japanese Patent Laid-Open Publication No. 63-231469 which employs a developing roller alone as the toner delivery means. Another known system employs, in addition to the developing roller, a delivery or supply roller that first delivers the toner to the developing roller that thereafter delivers the toner to the electrostatic latent image carrier.

In the latter developing apparatus, the supply roller for delivering the toner normally is disposed substantially beneath a toner hopper storing the toner therein, and the toner dropped from the toner hopper is supplied to a developing roller. A restricting or doctor blade contacts the developing roller and restricts the thickness of the toner layer on the surface of the developing roller. The blade is urged toward contact with the developing roller under pressure by a spring. The toner layer of restricted thickness is delivered to the electrostatic latent image carrier by the rotation of the developing roller per se, and hence the latent image is developed.

Since the supply roller supplies toner dropped thereon from the toner hopper and accumulated thereon, the amount of toner to be supplied to the developing roller is large, and the toner layer on the developing roller composed of a large amount of toner is thinned by the blade. The toner that is removed or stopped by the blade is residual and is maintained in a reservoir disposed upstream of the delivery direction. During the course of developing process, the amount of toner in the reservoir is increased and will fully occupy the entire space of the reservoir. Further supply the toner into the reservoir when it is fully occupied by toner permits the blade to push or lift upwardly from the surface of the developing roller against the resilient force of the spring due to the pressure of the toner. Consequently, there will be a space between the surface of the developing roller and the tip end of the blade, and there is a likelihood that the layer of the toner restricted by the blade will be undesirably thick. Furthermore, there is a likelihood that the toner will be compressed and solidified by such pressure of the toner, such that toner particles having large diameters will be delivered to the developing position. For these reasons, there have occurred such problems that the substrate on which the image is developed is contaminated, suitable resolution cannot be obtained, and surplus toner is absorbed by the electrostatic latent image carrier at the time of developing.

SUMMARY OF THE INVENTION

It is an object of the present invention to provide a developing apparatus capable of obtaining suitable resolution, without contaminating a substrate of a printing medium and affecting printing, by restricting the amount of toner to be supplied from a supply roller and by thinning a toner layer by means of a doctor blade.

To achieve this object, the developing apparatus according to the present invention supplies a developer or toner from a hopper to a developing roller by the rotation of the supply roller, a toner layer on the developing roller is thinned by the doctor blade, the toner layer is transferred to an electrostatic latent image carrier to develop an image, and a restriction member for restricting the amount of toner to be supplied to the supply roller is provided at a position midway of the route through which the toner is supplied from the hopper to the supply roller.

The restriction member has therein through holes extending over the entire length of the supply roller in the axial direction thereof.

With the arrangement set forth above, the amount of the developer or toner to be supplied to the supply roller is restricted and the amount of the developer to be supplied to the developing roller is restricted by the provision of the restriction member in the midway portion of the route through which the developer or toner is supplied from the hopper to the supply roller. Accordingly, the toner does not fully fill a reservoir disposed upstream of the blade. Hence, toner pressure does not increase sufficiently to lift the developing away from the developing roller. As a result, the layer of the toner on the developing roller is appropriately thinned by the blade. This eliminates contamination of the substrate of the printing medium and makes it possible to obtain suitable resolution.

The above and other objects, features and advantages of the present invention will become more apparent from the following description taken in conjunction with the accompanying drawings.

DESCRIPTION OF THE PREFERRED EMBODIMENTS

Figure 1:
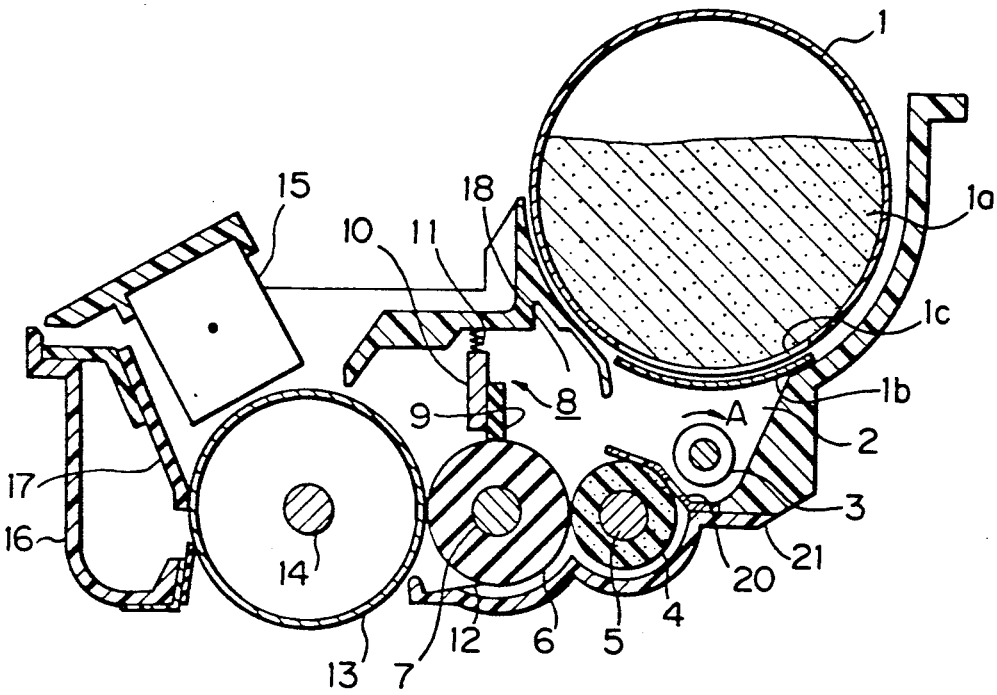
FIG. 1 is a cross sectional view of a developing apparatus according to a first embodiment of the present invention.
Figure 2:
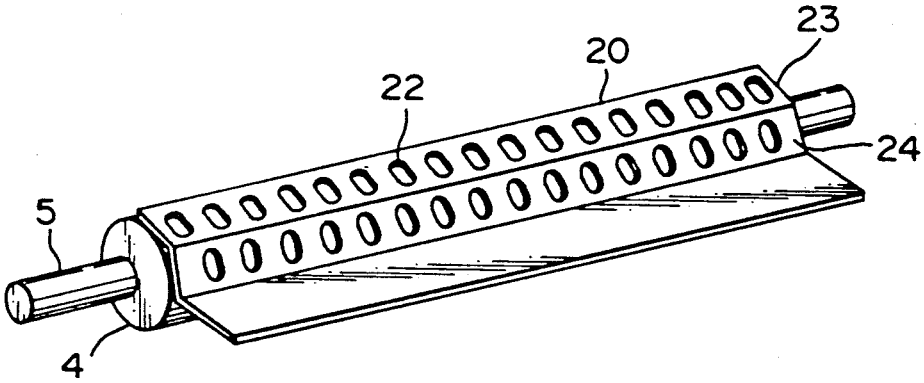
FIG. 2 is a perspective view of a toner delivery restriction plate employed in the first embodiment of the present invention.
Figure 3:
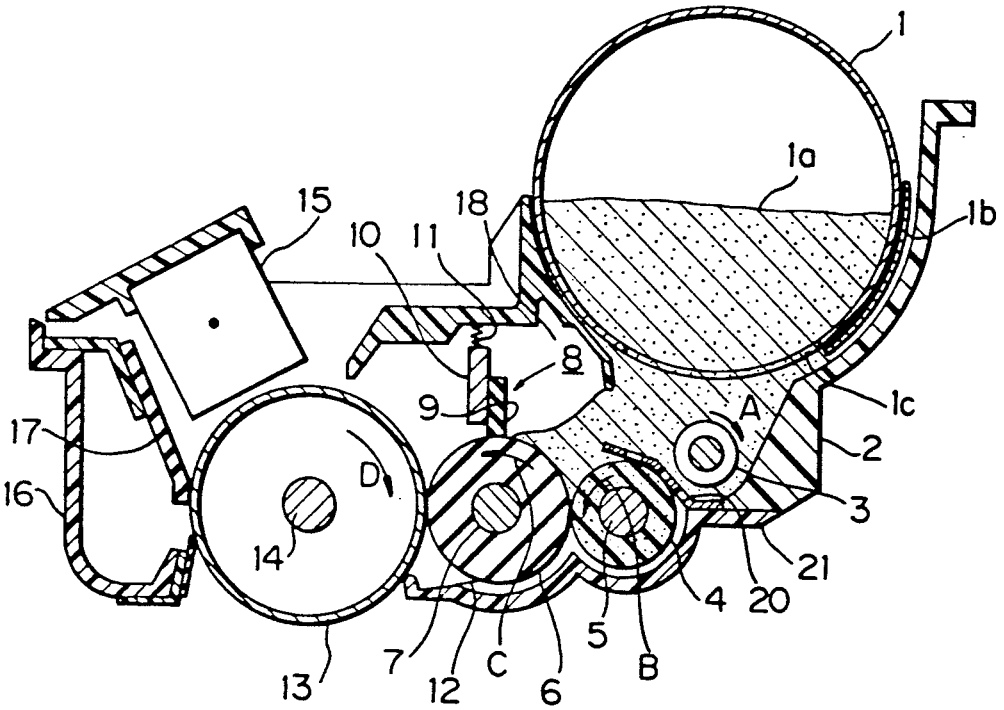
FIG. 3 is a cross sectional view showing the operation of the first embodiment.

First Embodiment (FIGS. 1 to 3)

A developing apparatus according to a first embodiment will be described with reference to FIGS. 1 to 3.

A developing apparatus for supplying developer to an electrostatic latent image carrier and development thereof comprises a toner cartridge 1 for containing toner 1*a* as the developer, a toner hopper 2 formed under the toner cartridge 1 for storing or stagnating toner 1*a* that has fallen from the toner cartridge 1, a stirring shaft 3 in the toner hopper 2 for stirring toner 1*a* that is stagnant in the toner hopper 2, a supply roller 4 rotatably provided at a position downwardly aslant of stirring shaft 3 for delivering and supplying the toner 1*a*, a toner delivery restriction plate 20 provided between the toner hopper 2 and the supply roller 4 for restricting the amount of toner supplied.

A shutter 1*b* is provided beneath cartridge 1, and an opening 1*c* allows the toner 1*a* to pass downward therethrough by opening the shutter 1*b*. The stirring shaft 3 is rotated in the direction of the arrow A for stirring the toner that is stagnant in the toner hopper 2. The supply roller 4 is made of foamable materials such as urethane and the like and is conductive. The supply roller 4 has a central shaft 5 made of a metal to which is applied a predetermined bias current, not shown. The toner delivery restriction plate 20 is fixed to a frame 21. The toner delivery restriction plate 20 has a length substantially the same as the axial length of the supply roller 4 as shown in FIG. 2 and is bent in a doglegged shape in cross section. A part of the plate 20 covers the supply roller 4 and has a plurality of through holes 22. The toner in the toner hopper 2 can reach the supply roller 4 through the plurality of through holes 22. The toner delivery restriction plate 20 is made of a metal but may be made of a resin. The through holes 22 are spaced substantially at equal intervals in the axial direction of the supply roller 4. The through holes 22 in a first row 23 are staggered with respect to those of a second row 24 in the axial direction of the supply roller 4. The intervals between adjacent through holes 22 of the first row 23 are the same as those of adjacent through holes 22 of the second row. With such an arrangement, the toner 1*a* in the hopper 2 can be supplied uniformly over the entire axial length of the supply roller 4.

Although the shape of the through holes 22 is oval in the arrangement illustrated in FIG. 2, the present invention is not limited to such shape, which may be circular or rectangular. A plurality of through holes 22 is not necessary, and may be formed as a single slit extending axially of the supply roller 4.

According to the illustrated arrangement of the present embodiment, the toner delivery restriction plate 20 contacts the supply roller 4, but the toner delivery restriction plate 20 need not always contact the supply roller 4.

The developing apparatus further comprises a developing roller 6 rotatably fixed to the developing apparatus by driving means, not shown, a restricting or doctor blade 8 disposed over and contacting the developing roller 6 for thinning a toner layer formed around the developing roller 6, and a toner reservoir 18 provided in a space defined at a side of the developing blade 8 spaced from a drum 13 for accommodating toner which does not pass through an interval between the blade 8 and the developing roller 6. Drum 13 is sensitive and is an electrostatic latent image carrier rotatably fixed to driving means, not shown and disposed at a side of the developing roller 6. A first charger 15 extends substantially over the sensitive drum 13 for charging the surface of the sensitive drum 13, and a cleaning device 16 is disposed at a side of the sensitive drum 13 opposite roller 6 and includes a cleaning blade 17 for scraping residual toner from the surface of the sensitive drum 13 after transfer of a toner image to a substrate of a printing medium. A partition plate 12 is fixed to contact a lower portion of developing roller 6 for preventing the toner from scattering outside the developing apparatus.

The developing roller 6 is formed of a conductive and elastic rubber or the like and has a central metal shaft 7 to which is applied a bias voltage. The supply roller 4 and the developing roller 6 respectively serve to deliver the toner to a developing position by rotation thereof. The blade 8 comprises a rubber portion 9 contacting the developing roller 6 and a metal portion 10 supporting the rubber portion 9. A given pressing force is imparted to the blade 8 when it is pressed by a spring 11 toward the developing roller 6.

The developing apparatus having the arrangement set forth above is operated as follows.

In FIG. 3, when power is ON, the stirring shaft 3, the supply roller 4 and the developing roller 6 are respectively rotated by the driving means, not shown, in the directions of arrows A, B and C. When the shutter 1*b* is turned, the toner 1*a* is dropped through the opening 1*c* of the toner cartridge 1 into the toner hopper 2. The toner 1*a* enters the reservoir 18 and is accumulated on the toner delivery restriction plate 20. The amount of the toner entered from the toner hopper 2 is kept at a predetermined amount. However, the amount of the toner supplied from the supply roller 4 is restricted by the toner delivery restriction plate 20. According to the present embodiment, the size and the number of the through holes 22 as illustrated in FIG. 2 are set such that the amount of toner passing through holes 22 is slightly greater than the amount of the toner which is restricted by the blade 8.

The toner 1*a* that has passed the toner delivery restriction plate 20 and attached to the supply roller 4 is delivered to the toner reservoir 18. The amount of the toner 1*a* supplied afresh from the hopper 2 to the toner reservoir 18 is substantially the same as the amount that has passed the toner delivery restriction plate 20. The toner 1*a* attached to the surface of the developing roller 6 in the toner reservoir 18 is delivered to the position where the developing roller 6 contacts the blade 8 by the rotation of the developing roller 6. The toner laid over the developing roller 6 is thinned to a predetermined thickness, e.g. to several tens of microns, by the blade 8. Inasmuch as the amount of the toner in the toner reservoir 18 is kept substantially constant, the toner reservoir 18 does not become filled by the toner, and hence the toner in reservoir 18 does not affect the thinning operation by the blade 8.

The thus thinned charged toner is employed to develop a toner image of the electrostatic latent image at the position of contact with the sensitive drum 13.

The toner which is not employed for development, residual toner on the developing roller 6, is removed by the rotation of the developing roller 6 in the direction of the arrow C and reaches a position contacting the supply roller 4. As mentioned above, the supply roller 4 is sponge-like and has a plurality of minute convex and concave portions at the surface thereof. The supply roller also functions to scrape the residual toner from the developing roller by contacting the developing roller 6 while rotating.

Inasmuch as there is provided a toner delivery restriction plate 20 as set forth above according to the present invention, the amount of toner is restricted so that the toner layer of the developing roller 6 can be thinned appropriately by the blade.

Figure 4:
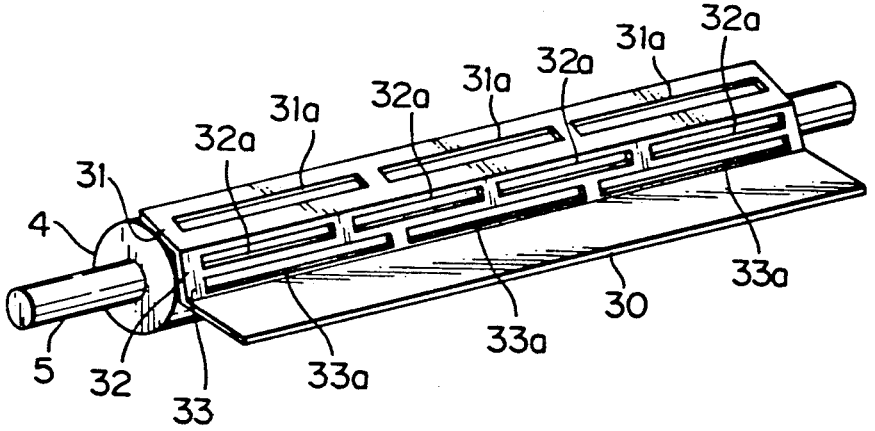
FIG. 4 is a perspective view showing a toner delivery restriction plate employed in a second embodiment of the present invention.
Figure 5:
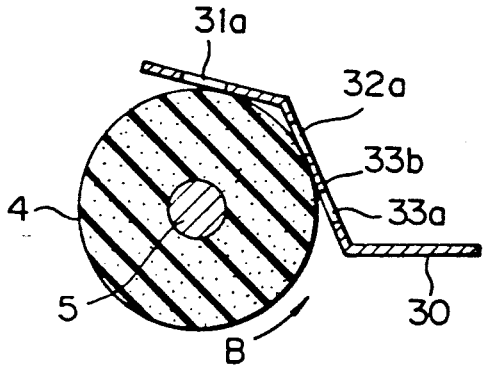
FIG. 5 is a partial sectional view showing an operation of scraping toner according to the second embodiment.

Second Embodiment (FIGS. 4 and 5)

A developing apparatus according to a second embodiment will be described with reference to FIGS. 4 and 5.

In FIG. 4, a toner delivery restriction plate 30 according to the second embodiment is formed to extend over and cover the entire length of the supply roller 4. There are provided rectangular slits through the portion of plate 30 covering the supply roller 4 along the axial direction thereof. Among such slits are slits 31*a* in a first row 31 and slits 32*a* in a second row 32 and functioning to supply toner in the toner hopper 2 to the supply roller 4, i.e. as supply slits. Slits 33*a* in a third row 33 function to scrape the toner attached to the supply roller, i.e. as scraping slits. This is described more in detail with reference to FIG. 5.

In FIG. 5, the surface of the supply roller 4 has a plurality of minute convex and concave portions. The toner delivery restriction plate 30 contacts the surface of the supply roller 4. Suppose that the toner is filled in the toner hopper 2 and is positioned substantially over the toner delivery restriction plate 30. The toner passed through the slits 31*a* in the first row 31 and the toner passed the slits 32*a* of the second row 32 is moved toward the supply roller 4. The size and the number of the slits 31*a* of the first row 31 and the slits 32*a* of the second row 32 are determined such that the amount of the toner to be supplied to the supply roller 4 is optimum.

Upper ends 33*b* of the slits 33*a* in the third row are brought into contact with the supply roller 4 under pressure. The supply roller 4, as set forth above, functions to scrape residual toner from the developing roller 6. However, the surface of roller 4 is likely to become clogged due to the repetitive operation of delivery of the toner. When the surface of the supply roller thus is clogged, the function of roller 4 to scrape the residual toner from the developing roller 6 is not fully achieved. Since the upper ends 33*b* of the slits 33*a* in the toner delivery restriction plate 30 are brought into contact with the supply roller 4 under pressure, and the supply roller 4 is rotated in the direction of the arrow B, i.e. in the direction to bring roller 4 into contact with the upper ends 33*b* of the slits 33*a*, the toner clogging the surface of the supply roller 4 is scraped therefrom. At this time, although toner in the toner hopper 2 and on the toner delivery restriction plate 30 can enter the slits 33*a*, the amount of such entering toner is relatively slight.

There is generated a large scraping force by the upper ends 33*b* of slits 33 against toner clogging the surface of the supply roller 4 because the supply roller 4 is formed as an elastic sponge-like member. The toner clogging the surface of the supply roller 4 enters into toner having a low density with the toner hopper. That toner clogging the surface of the supply roller 4 is scraped by the upper ends 33*b* of slits 33 and thus the clogging problem can be eliminated.

The supply roller 4, with the surface thereof unclogged, receives further toner again from the slits 32*a* and 31*a*. However, a large amount of fresh toner is delivered to the developing roller, hence the toner on the surface of the supply roller 4 is less residual. The residual toner on the developing roller 6 is scraped therefrom by the supply roller 4.

As explained above, the toner delivery restriction plate according to the second embodiment functions to restrict the amount of toner and to enable scraping of residual toner from the developing roller by eliminating the problem of clogging of the supply roller. Accordingly, there are such effects according to the second embodiment that the thickness of the toner layer on the developing roller can be restricted appropriately and residual toner on the developing roller can be eliminated, thereby avoiding undesired images occurring during developing.

Figure 6:
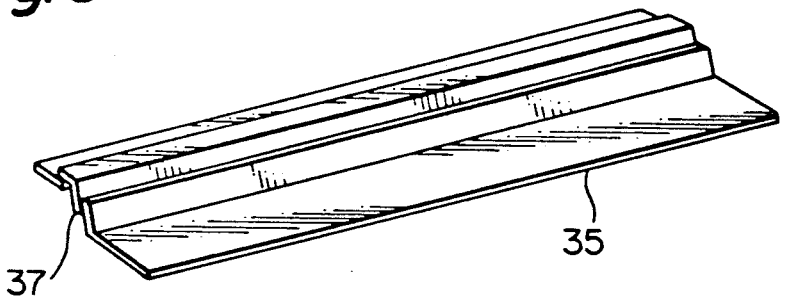
FIG. 6 is a perspective view of a toner delivery restriction plate according to a modified embodiment of the present invention.
Figure 7:
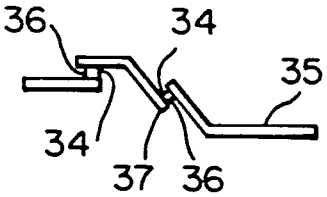
FIG. 7 is an enlarged side view of the plate of FIG. 6.

Although the invention has been described above with regard to first and second embodiments, it is to be understood that many variations and changes are possible. For example, the toner delivery restriction plate can be varied as illustrated in FIG. 6. The delivery restriction plate 35 comprises three plates connected with each other in a manner to provide predetermined gaps 34 therebetween. As illustrated in FIG. 7, connecting members 36 connect the three plates with each other and define the predetermined gaps 34. Members 36 may be positioned at opposite ends and at the central portion of the plate 35. With such an arrangement, the toner can pass through gaps 34. The sizes of the gaps 34 are such that the optimum amount of the toner can pass through the gaps. Edge portions 37 of the toner delivery restriction plate 35 as illustrated in FIG. 7 can be brought into contact with the supply roller 4 to scrape toner clogging the surface thereof.

We claim:

1. A developing apparatus for supplying developer to a carrier of a latent image to develop the image, said apparatus comprising:
   - a hopper storing therein a supply of developer;
   - a supply roller positioned beneath said hopper for receiving developer therefrom;
   - a developing roller positioned in contact with said supply roller to receive developer therefrom and to deliver the developer to the carrier for development;
   - a blade urged under pressure toward said developing roller for restricting a thickness of a layer of developer delivered thereby to the carrier;
   - a restriction member positioned in a path of the developer from said hopper to said supply roller, thereby restricting an amount of developer delivered to said supply roller, said restriction member comprises a plate having plural axially planar portions extending at angles to each other; and
   - said restriction member being positioned such that an edge of at least one opening contacts and scrapes developer from a surface of said supply roller.

2. An apparatus as claimed in claim 1, wherein said openings are arranged in plural, parallel axial rows.

3. An apparatus as claimed in claim 2, comprising at least two said rows.

4. An apparatus as claimed in claim 2, comprising at least three said rows.

5. An apparatus as claimed in claim 2, wherein said openings of adjacent said rows are offset axially of each other.

6. An apparatus as claimed in claim 2, wherein said openings are oval-shaped.

7. An apparatus as claimed in claim 2, wherein said openings comprise axially elongated slits.

8. An apparatus as claimed in claim 1, wherein said edge comprises a downstream edge of said at least one opening, relative to a direction of rotation of said supply roller.

9. An apparatus as claimed in claim 1, wherein said openings include plural openings spaced axially at equal intervals.

10. An apparatus as claimed in claim 1, wherein said plate comprises a plurality of planar plate members extending axially and connected by connecting members to define said openings between adjacent said plate members.

11. An apparatus as claimed in claim 10, wherein said connecting members are spaced axially at equal intervals.

12. An apparatus as claimed in claim 10, wherein said edge comprises an upstream edge, relative to a direction of rotation of said supply roller, of one of said planar plate members defining said at least one opening.

* * * * *